US005628135A

United States Patent [19]

Cady

[11] Patent Number: 5,628,135

[45] Date of Patent: May 13, 1997

[54] SHOOTING SUPPORT FOR RIFLES AND HANDGUNS

[76] Inventor: Richard C. Cady, P.O. Box 130184, Coram, Mont. 59913

[21] Appl. No.: 576,828

[22] Filed: Dec. 21, 1995

[51] Int. Cl.[6] ..... F41A 23/00

[52] U.S. Cl. ..... 42/94; 89/37.04

[58] Field of Search ..... 42/94; 89/37.01, 89/37.04

[56] References Cited

U.S. PATENT DOCUMENTS

| | | | |
|---|---|---|---|
| 1,977,629 | 10/1934 | Heavey | 89/40.06 |
| 2,003,327 | 6/1935 | Woodberry | 89/40.06 |
| 2,589,039 | 3/1952 | Booth | 89/40.06 |
| 2,847,909 | 8/1958 | Kester | 42/94 |
| 3,225,656 | 12/1965 | Flaherty et al. | 89/37.04 |
| 3,608,852 | 9/1971 | Horn | 42/94 |
| 3,863,376 | 2/1975 | Dalmaso | 42/94 |
| 4,026,057 | 5/1977 | Cady | 42/94 |
| 4,409,751 | 10/1983 | Goda et al. | 42/94 |
| 4,548,393 | 10/1985 | Rickling | 269/156 |
| 4,575,964 | 3/1986 | Griffin | 42/94 |
| 4,580,483 | 4/1986 | Garbini | 89/40.06 |
| 4,799,324 | 1/1989 | Nodo | 42/94 |
| 4,819,359 | 4/1989 | Bassett | 42/94 |
| 4,844,390 | 7/1989 | Duke | 42/94 |
| 4,924,616 | 5/1990 | Bell | 42/94 |
| 4,967,497 | 11/1990 | Yakscoe | 42/94 |
| 4,971,208 | 11/1990 | Reinfried, Jr. et al. | 211/64 |
| 5,070,636 | 12/1991 | Mueller | 42/94 |
| 5,081,783 | 1/1992 | Jarvis | 42/94 |
| 5,497,575 | 3/1996 | Fried | 42/94 |

OTHER PUBLICATIONS

"Benchmaster Delivers" brochure published date unknown but prior to invention.

*Primary Examiner*—Michael J. Carone
*Assistant Examiner*—Theresa M. Wesson
*Attorney, Agent, or Firm*—Harry M. Cross, Jr.

[57] ABSTRACT

The gun support of this invention comprises a base having a front end and a rear end, a front leg support assembly longitudinally movable between the front end and the rear end and having a pair of front support legs, and a rear leg support assembly at the rear end having a rear support leg. A gun forearm rest assembly is mounted to the front end of the base, and a gun butt support assembly is mounted to the rear end of the base. The front leg support assembly is so constructed that the front legs are longitudinally movable relative to the rear leg support assembly and the gun forearm rest assembly, and so that the front legs are pivotable between downward and outward support positions and inward collapsed positions. The base is so constructed that the rear leg support assembly is longitudinally movable so that the rear leg is longitudinally movable relative to the gun forearm rest assembly, and so that the rear leg is pivotable between a downward and outward support position and an inward collapsed position.

6 Claims, 5 Drawing Sheets

SHOOTING SUPPORT FOR RIFLES AND HANDGUNS

BACKGROUND OF THE INVENTION

1. Field of the Invention

This invention relates to supports for rifles and handguns to aid in aiming and firing. More particularly, this invention relates to such supports that are intended for use when field and bench shooting.

2. Brief Description of the Prior Art

This invention is an improvement over the shooting support described in U.S. Pat. No. 4,026,057 to Wayne Cady. The shooting support described in that patent was primarily intended for use when field shooting, although it was also useful when bench shooting.

SUMMARY OF THE INVENTION

The present invention improves the portability and adjustability of shooting supports of the type described in U.S. Pat. No. 4,026,057. Portability is enhanced by providing a base that has both front and rear legs that are pivotable to either a collapsed storage position or to an extended operating position, and by providing a forearm rest connection that enables a forearm rest to be easily collapsed to a storage position or extended to an operating position. Portability and adjustability are enhanced by providing for a telescoping base connection between a rear-mounted rifle butt support and a front-mounted forearm rest, and by providing for the front legs to be mounted on the base between the butt support and the forearm rest.

The gun support of this invention comprises a base having a front end and a rear end, a front leg support assembly longitudinally movable between the front end and the rear end and having a pair of front support legs, and a rear leg support assembly at the rear end having a rear support leg. A gun forearm rest assembly is mounted to the front end of the base, and a gun butt support assembly is mounted to the rear end of the base. The front leg support assembly is so constructed that the front legs are longitudinally movable relative to the rear leg support assembly and the gun forearm rest assembly, and so that the front legs are pivotable between downward and outward support positions and inward collapsed positions. The base is so constructed that the rear leg support assembly is longitudinally movable so that the rear leg is longitudinally movable relative to the gun forearm rest assembly, and so that the rear leg is pivotable between a downward and outward support position and an inward collapsed position.

The front leg support assembly comprises a first elongated member having a front end to which the gun forearm rest assembly is mounted, and the front legs are mounted by the first elongated member so that said front legs are longitudinally movable with respect to said gun forearm rest assembly and with respect to said rear leg support assembly. The rear leg assembly comprises a second elongated member telescopically connected to the first elongated member to enable the rear leg to longitudinally move toward and away from the gun forearm rest assembly.

The gun forearm rest assembly comprises a transverse hollow cylinder attached to the front end of the first elongated member. The cylinder has multiple cutouts notched into a first end thereof. Positioning means are rotatably contained by the cylinder and include a positioning member displacable into and out of the cutouts and locking means for securing the positioning member into the cutouts. A forearm elevating rod is attached to the positioning member so that the rod can be pivoted between vertical and horizontal positioned by rotating the positioning means within the cylinder and so that the rod can be locked into vertical and horizontal positions by the locking means. A gun forearm rest assembly is adjustably mounted by said forearm elevating rod.

DESCRIPTION OF THE PREFERRED EMBODIMENT

Figure 1:
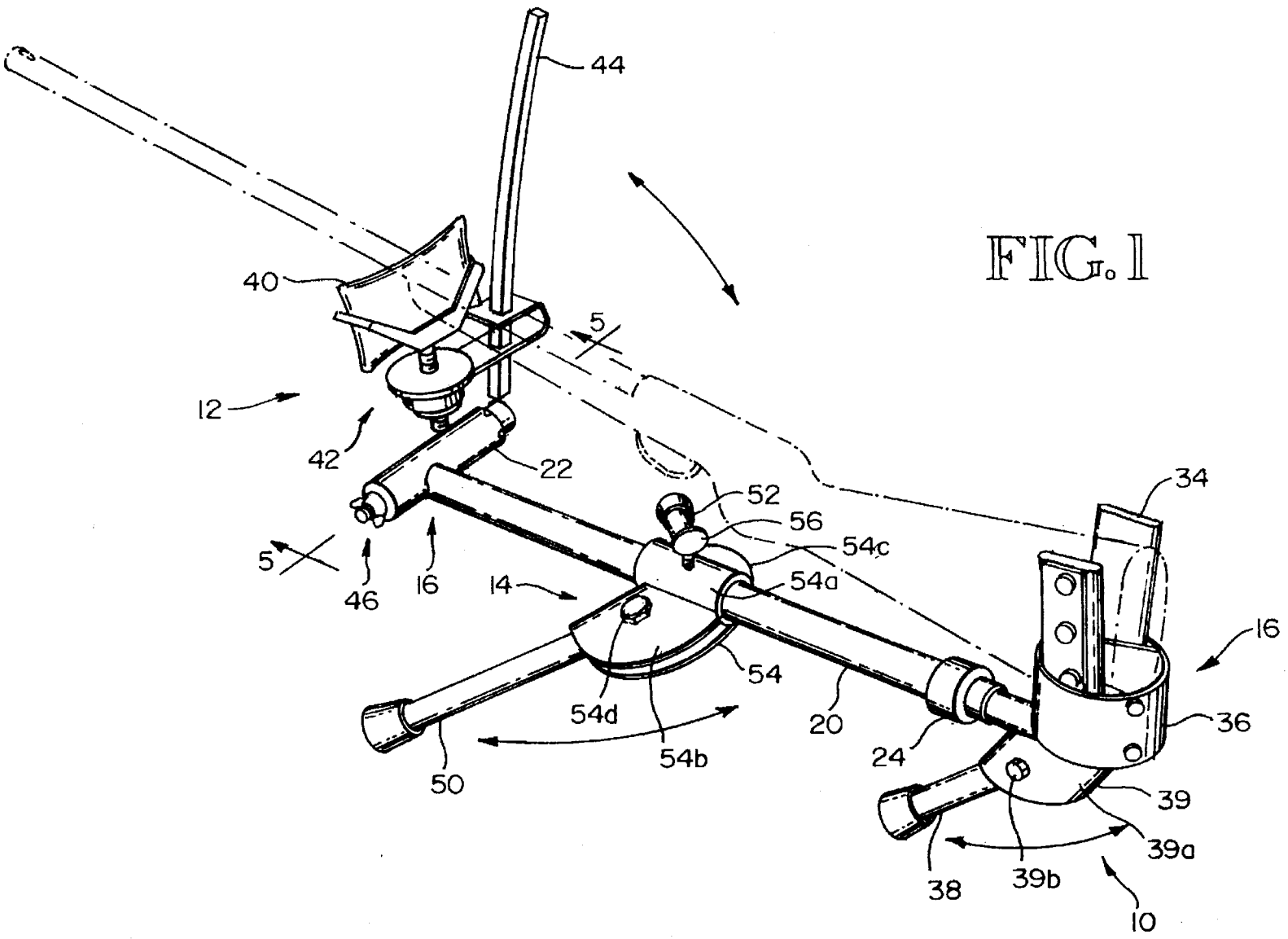
FIG. 1 is a perspective view of the preferred embodiment of the gun support of the invention taken from the rear of the gun support, with a rifle shown in dashed line positioned in the gun support and with the gun support adjusted for that rifle.

The shooting support of this invention is herein termed a "gun support" to signify that is can be used with a long gun such as a rifle or shot gun, and with a hand gun or pistol. The term "gun support" is not intended to encompass other types of firearms inasmuch as the it is intended for use by the sportsman/hunter; such as for sighting rifles, shot guns and pistols, target shooting the same, stationary hunting of varmints and the like, testing ammunition, sighting-in scopes, and so forth. The gun support of this invention is an apparatus that is not attached to the gun, but rather is an apparatus that is set in place and then the gun positioned in the apparatus for shooting.

The gun support illustrated in the drawings, the preferred embodiment, comprises a rear leg assembly 10, a front forearm rest assembly 12, a front leg assembly 14, and a gun butt support assembly 16. The front leg assembly 10 comprises an elongated hollow tube 20 that is fitted at its front end with a transverse hollow cylinder 22 and at its rear end with a locking screw collar 24 through which is threaded a locking thumb screw 26. The front leg assembly 14 further comprises two front legs 50, 52 and a front leg mounting bracket 54 that is adapted to slidably fit over tube 20 and to be fixed in a desired location on tube 20 by a thumb screw 56 threaded through bracket 54, and that pivotably mounts legs 50, 52. The rear leg assembly 10 comprises an elongated tube 30 adapted to slidably fit within tube 20, a rear leg 38, and a rear leg mounting bracket 39 attached to tube 30 opposite to bracket 34 and pivotably mounting rear leg 38. The front leg assembly and the rear leg assembly comprise a longitudinally adjustable base for the forearm assembly 12 and the gun butt support assembly 16. The front forearm rest assembly 12 comprises a cushioned forearm rest 40, a vertically-adjustable forearm rest bracket subassembly 42, a vertical forearm rest support leg 44 which carries subassembly 42, and a support leg mounting subassembly 46 that pivotably mounts leg 44 to cylinder 22. The gun butt support assembly 16 comprises a gun butt cradle 32, comprised of a V-shaped bracket 34 attached to tube 30 opposite to bracket 39, and a gun recoil strap 36 attached to bracket 34.

Figure 2:
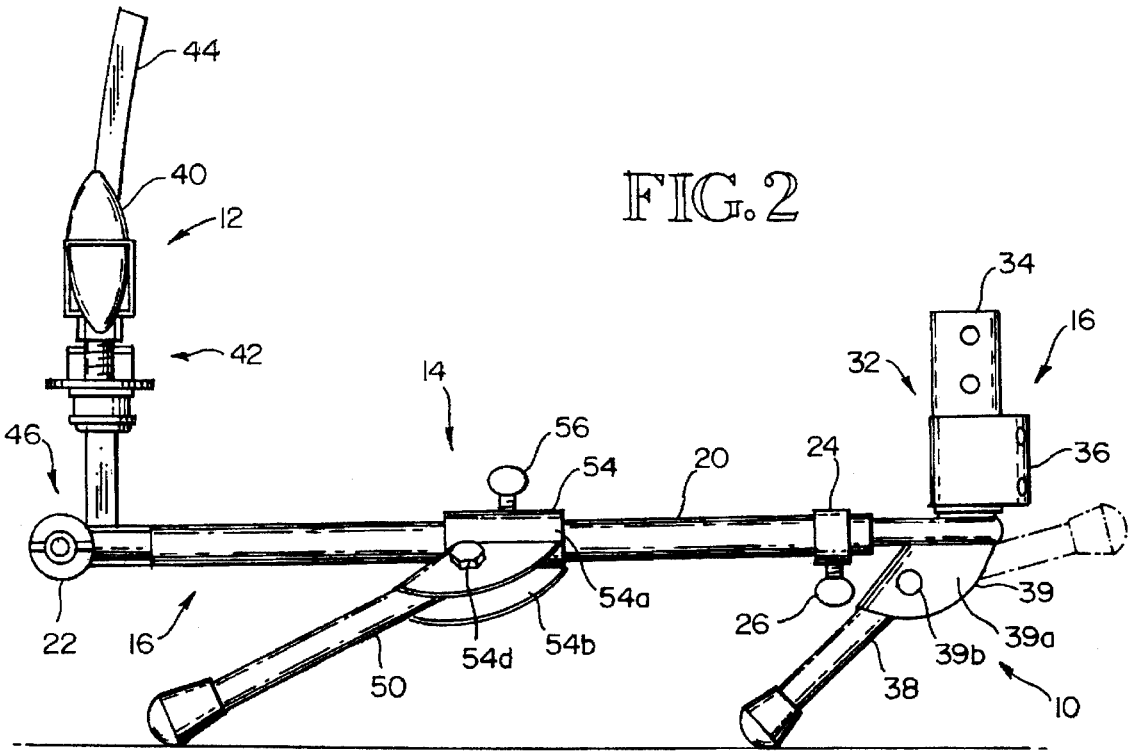
FIG. 2 is a side elevation view of the FIG. 1 gun support.
Figure 3:
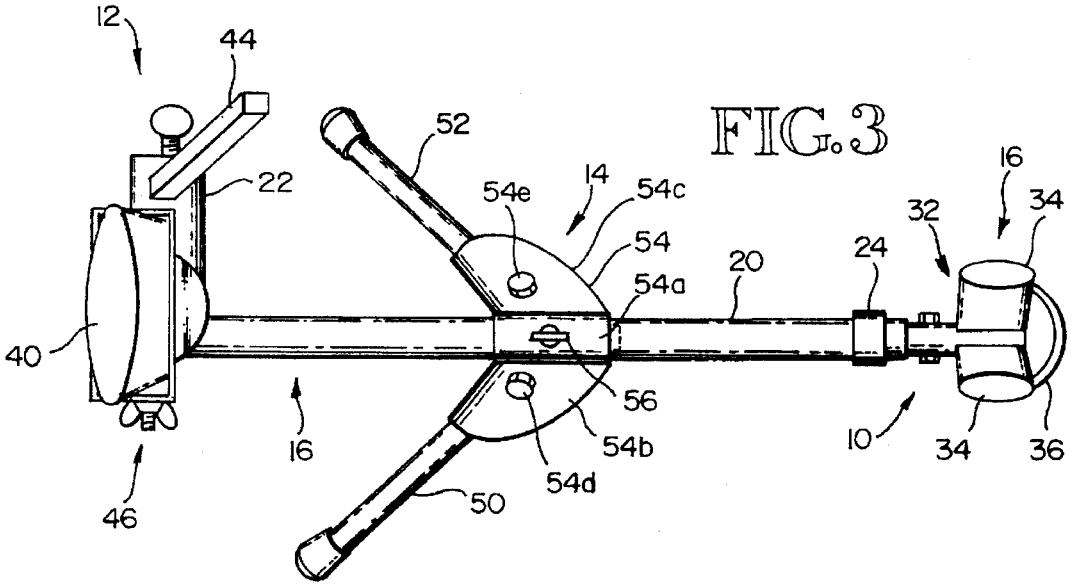
FIG. 3 is a top plan view of the FIG. 1 gun support.

Front leg mounting bracket 54 comprises a sleeve 54*a* that slidably contains tube 20, and two leg-mounting receptacles 54*b*, 54*c*. Each front leg is inserted into one of the receptacles and retained therein by a pivot pin 54*d*, 54*e* that extends through the receptacle side walls. Each receptacle has a closed front edge that limits the forward pivotal movement of the front leg and upper and lower side walls that guide the front leg in its pivotal movement. The upper and lower side walls of each receptacle also support and stabilize the front leg against downward forces that might tend to spread or collapse the front legs. The side walls project downwardly from the sleeve 54*a* at an acute angle from the horizontal and the front edge projects forwardly at an acute angle with respect to the longitudinal axis of tube 20. Therefore, the legs 50, 52 can project forwardly and downwardly at those acute angles as shown in FIGS. 2 and 3. Also, with the side walls defining cavities opening rearward for the respective front legs, those legs can be pivoted to extend rearwardly, approximately parallel to the longitudinal axis of tube 20, for storage and shipping, as shown in dotted line in FIG. 3.

The rear leg mounting bracket 39 is rigidly attached to tube 30 and provides a leg-mounting receptacle 39*a* for leg 38. The rear leg is inserted into the receptacle and retained therein by a pivot pin 39*b* that extends through the receptacle side walls. The receptacle has a closed front edge that limits the forward pivotal movement of the rear leg. The front edge projects forwardly at an acute angle from the longitudinal axis of tube 30 so that leg 38 can project forwardly at that acute angle as shown in FIG. 2. Also, with the side walls defining a cavity opening rearward for the rear leg, the leg can be pivoted to extend rearwardly, approximately parallel to the longitudinal axis of tube 30, for storage and shipping, as shown in dotted line in FIG. 2.

Because of the structure of the base, the rear leg 38 and its mounting bracket 39 are longitudinally adjustable with respect to the forearm assembly 12, and the front legs 50, 52 and their mounting bracket 54 are longitudinally adjustable with respect to both the forearm assembly 12 and the rear leg 38. Furthermore, the front leg mounting bracket 54 is rotatable about the longitudinal axis of tube 20 so as to effect any desired rotated attitude for the front legs that might be required by the terrain upon which the gun support is to be positioned. Therefore, for any particular location where the gun support is to be positioned, the rear leg 38 and the front legs 50, 52 may be independently positioned longitudinally, and the attitude of the front legs with respect to the rear leg and with respect to the forearm assembly may be independently adjusted. In so far as the base for the gun support is concerned, the forearm rest assembly 12 is stationary. The rear leg assembly 10 is longitudinally movable relative to the forearm rest assembly. The front leg assembly 14 is also longitudinally movable relative to the forearm rest assembly. In order for the purposes of the invention to be accomplished, it is necessary that the longitudinally movable front leg assembly be located between the forearm rest assembly and the rear leg assembly and that the front-mounted forearm rest assembly be the stationary element in the system.

Figure 4:
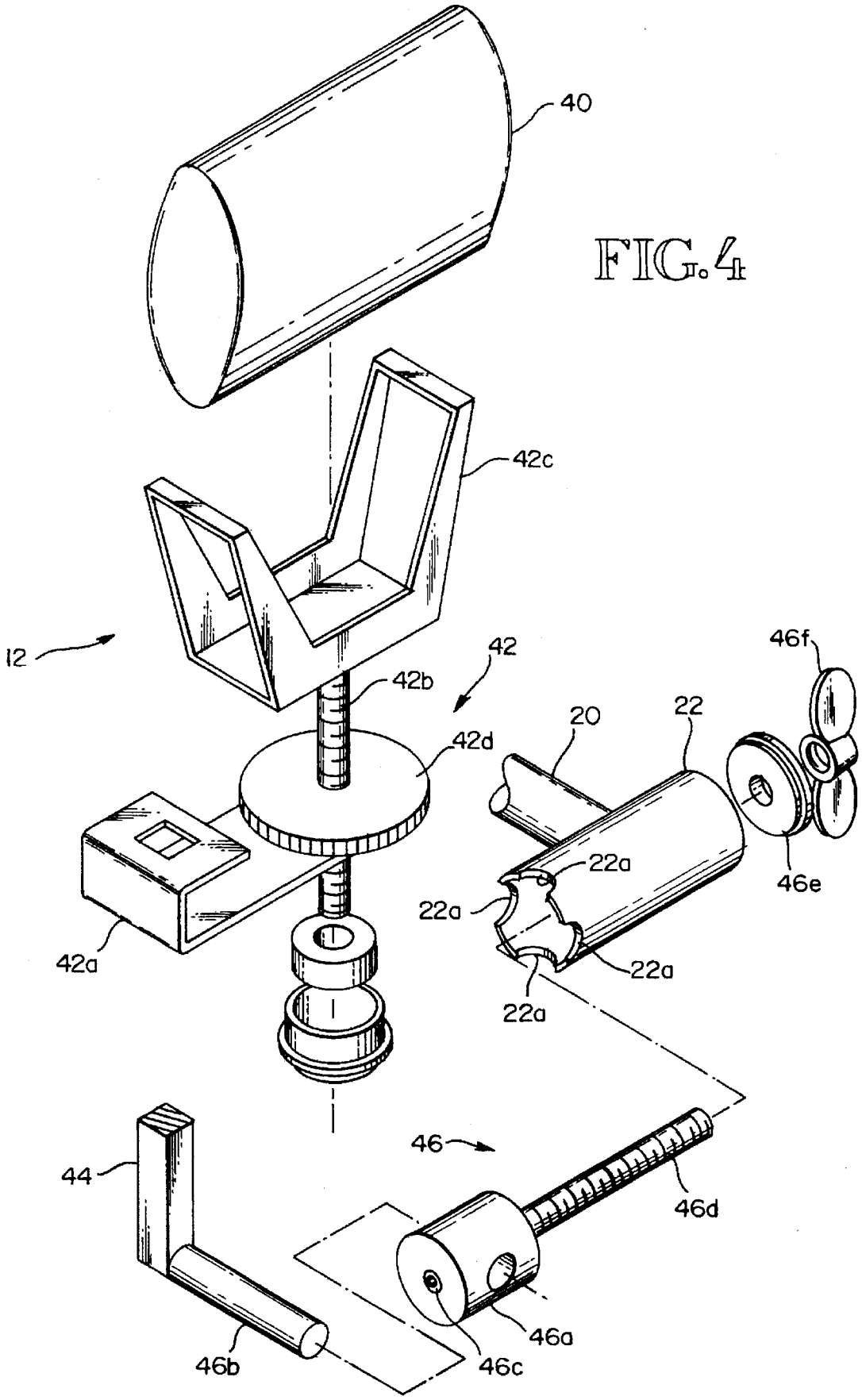
FIG. 4 is an expanded view of the FIG. 1 gun support's forearm rest assembly.

The forearm rest bracket subassembly 42, as shown in detail in FIG. 4, includes a clip 42*a* through which leg 44 extends, a threaded adjustment rod 42*b* and a forearm rest-carrying bracket 42*c* mounted atop rod 42*b*. Clip 42*a* may be vertically moved along leg 44 to position the forearm rest 40 to the approximate elevation desired. Clip 42*a* mounts fine elevation adjusting disk 42*d*, disk 42*d* in turn mounting threaded rod 42*b* in a threaded bore, so that a finer elevation adjustment of the forearm rest 40 may be effected by turning disk 42*d* so as to incrementally raise or lower bracket 42*c*.

Figure 5:
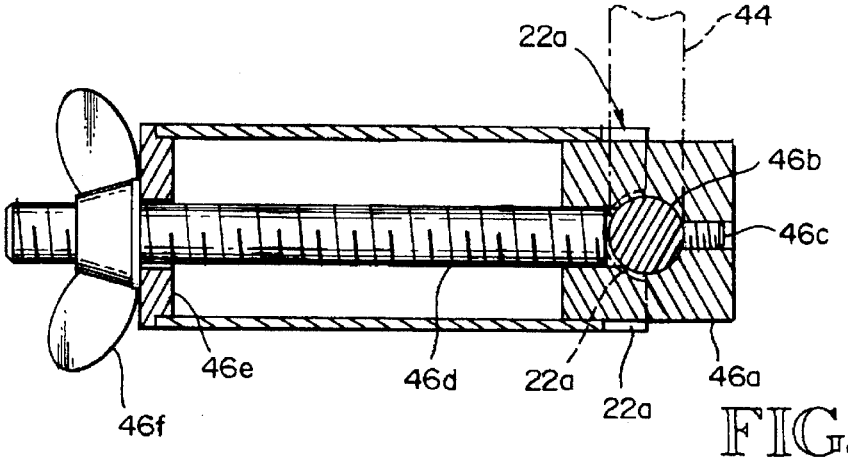
FIG. 5 is an enlarged detail view taken along the line 5—5 of FIG. 1.
Figure 6:
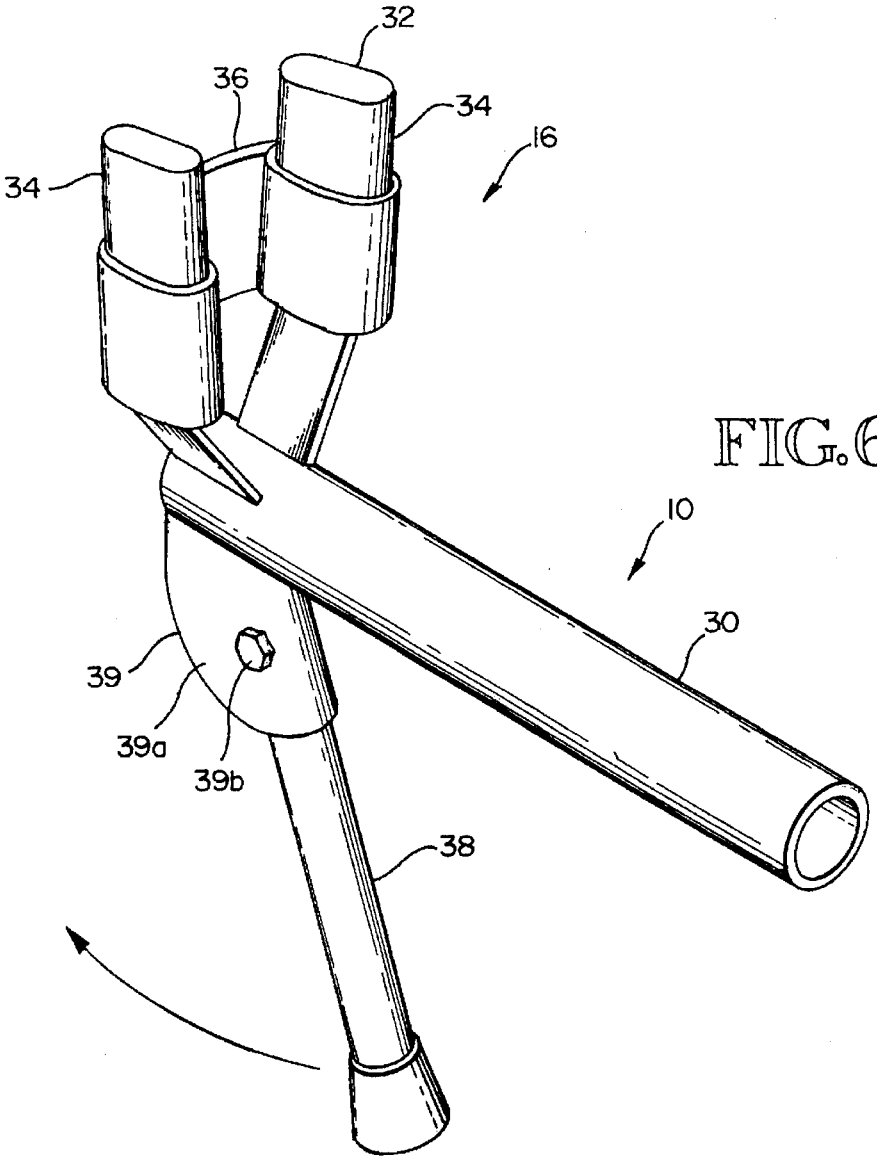
FIG. 6 is an enlarged perspective view of the FIG. 1 gun support's rear leg and gun butt support assembly as it would be positioned for supporting a rifle butt.

The forearm rest support leg mounting subassembly 46, as shown in detail in FIGS. 4 and 5, comprises a cylinder 46*a* through which a perpendicular leg aligning rod 46*b* is inserted and fastened therein by a set screw 46*c*. Cylinder 46*a* has a longitudinally-extending threaded bolt 46*d* long enough to extend through cylinder 22. Cylinder 46*a* fits within cylinder 22 so that aligning rod 46*b*, extending through cylinder 46*a*, may fit into the semicircular cutouts 22*a* in the rim adjacent rim of cylinder 22. The rim of cylinder 22 is provided with two pairs of cutouts 22*a* arranged perpendicular to one another; one pair oriented vertically and the other pair oriented horizontally. Cylinder bolt 46*d* mounts a bearing cap 46*e* and a wing nut 46*f* at its outer end so that cylinder 46*a* may be drawn into or loosened from cylinder 22 by tightening or loosening wing nut 46*f* on bolt 46*d*. When wing nut 46*f* is tightened, the aligning rod 46*a* will be drawn toward the rim of cylinder 22 and into a pair of cutouts 22*a* if aligned thereto to lock the rod 46*a* into the cutouts. When wing nut 46*f* is loosened, the aligning rod 46*a* can be pulled out of a pair of cutouts 22*a* and released from locking engagement with the cutouts. When aligning rod 46*a* is placed in the horizontal pair of cutouts 22*a*, the forearm rest support leg 44 will be positioned in its vertical position—its operating position, shown in solid line in FIG. 1 and in dashed line in FIG. 5. When aligning rod 46*a* is placed in the vertical pair of cutouts 22*a*, the forearm rest support leg 44 will be positioned in its horizontal position—its storage and shipping position. The combination of the two cylinders 22, 46*a*, their interrelated tightening/loosening mechanism, and the relationship of the aligning rod 46*b* to the cutouts 22*a* provides a simple, positive locking arrangement to enable the forearm rest support rod 44 to be easily and positively locked into an upright operating position or to be quickly pivoted to and locked into its horizontal storage position.

Figure 7:
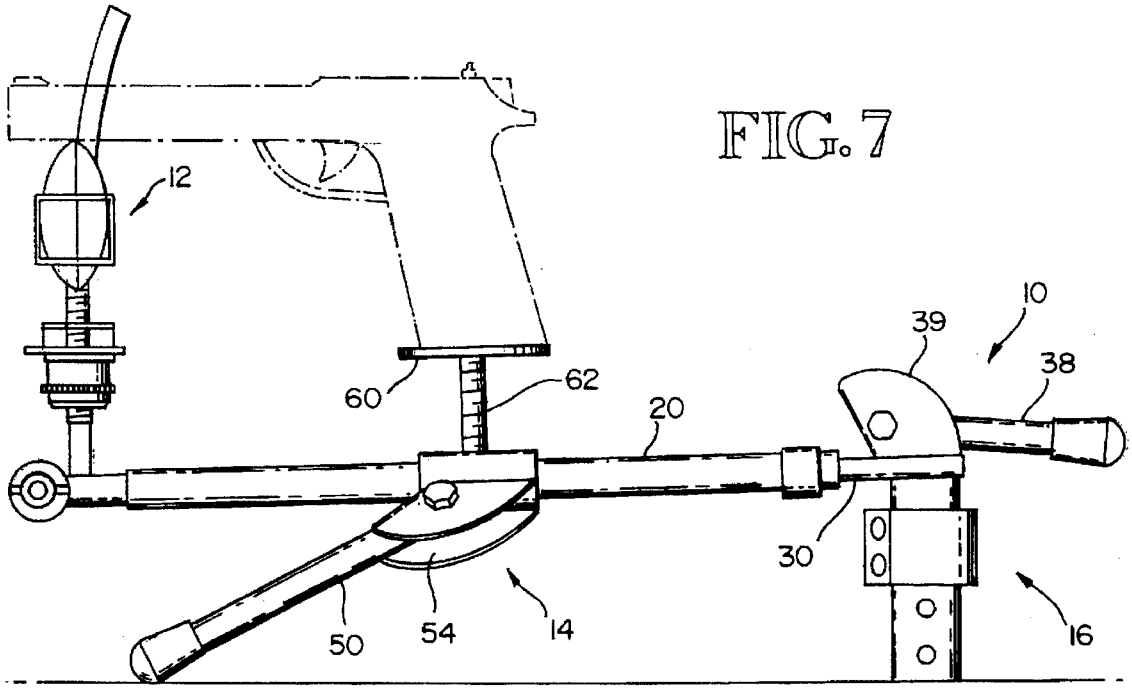
FIG. 7 is a side elevation view of the FIG. 1 gun support re-configured to support a hand gun, with the gun support's rear leg and gun butt support assembly adjusted to eliminate interference between the assembly and a shooter's forearm and elbow, a hand gun shown in dashed line positioned in the gun support and with the gun support adjusted for that hand gun.

FIG. 7 illustrates the gun support adapted for use with a hand gun. In this adaptation, the front leg locking thumb screw 26 is replaced by a hand gun butt support plate 60 to which is mounted a depending bolt 62. Bolt 62 is threaded into the threaded bore in the top of the front leg mounting bracket 54 in place of thumb screw 26. In order to enable this adaptation, it is necessary that the front legs 50, 52 and their mounting bracket 54 be longitudinally movable relative to the stationary forearm rest assembly 12. It is also necessary that the rear leg assembly 10 be rotatable in tube 20 so that the gun butt support assembly 16 can be rotated to a position below the rear leg 38 and its mounting bracket 39. When the gun butt support assembly is rotated into the position shown in FIG. 7, the V-shaped bracket 34 becomes the rear support for the base. To complete the adaptation for use with a hand gun, the rear leg 38 is rotated to its horizontal storage position as shown in FIG. 7 so that it is out of the way of the shooter's arm and shoulder. When the plate 60 is positioned for supporting the hand gun butt, the plate may be turned to tighten its bolt 62 into the front leg bracket 54, thereby stabilizing the plate 60 and setting the position of the front leg bracket 54 relative to tube 20.

While the preferred embodiment of the invention has been described herein, variations in the design may be made. The structure of the legs and their mounting brackets can be varied as can the structures of the gun butt support and the forearm rest without departing from the scope of this invention. The scope of the invention, therefore, is only to be limited by the claims appended hereto.

The embodiments of the invention in which an exclusive property is claimed are defined as follows:

1. A gun support comprising a base having a front end and a rear end, a front leg support assembly longitudinally movable between the front end and the rear end and having a pair of front support legs, and a rear leg support assembly at the rear end having a rear support leg; a gun forearm rest assembly mounted to the front end of the base; and a gun butt support assembly mounted to the rear end of the base;

said front leg support assembly being so constructed that the front legs are longitudinally movable relative to the rear leg support assembly and the gun forearm rest assembly, and so that the front legs are pivotable between downward and outward support positions and inward collapsed positions; and said base being so contructed that the rear leg support assembly is longitudinally movable so that the rear leg is longitudinally movable relative to the gun forearm rest assembly, and so that the rear leg is pivotable between a downward and outward support position and an inward collapsed position.

2. The gun support according to claim 1 wherein said front leg support assembly comprises a first elongated member having a front end to which said gun forearm rest assembly is mounted, and wherein said front legs are mounted by said first elongated member so that said front legs are longitudinally movable with respect to said gun forearm rest assembly and with respect to said rear leg support assembly; and wherein said rear leg assembly comprises a second elongated member telescopically connected to said first elongated member to enable said rear leg to longitudinally move toward and away from said gun forearm rest assembly.

3. The gun support according to claim 1 wherein said gun forearm rest assembly comprises a transverse hollow cylinder attached to the front end of said first elongated member, said cylinder having multiple cutouts notched into a first end thereof, positioning means rotatably contained by said cylinder including a positioning member displacable into and out of said cutouts and locking means for securing said positioning member into said cutouts, a forearm elevating rod attached to said positioning member so that said rod can be pivoted between vertical and horizontal positioned by rotating said positioning means within said cylinder and so that said rod can be locked into vertical and horizontal positions by said locking means, and a gun forearm rest assembly adjustably mounted by said forearm elevating rod.

4. The gun support according to claim 2 wherein said gun forearm rest assembly comprises a transverse hollow cylinder attached to the front end of said first elongated member, said cylinder having multiple cutouts notched into a first end thereof, positioning means rotatably contained by said cylinder including a positioning member displacable into and out of said cutouts and locking means for securing said positioning member into said cutouts, a forearm elevating rod attached to said positioning member so that said rod can be pivoted between vertical and horizontal positioned by rotating said positioning means within said cylinder and so that said rod can be locked into vertical and horizontal positions by said locking means, and a gun forearm rest assembly adjustably mounted by said forearm elevating rod.

5. The gun support according to claim 2 wherein said gun butt support assembly is attached to said second elongated member so that said gun butt support assembly is upright when said rear leg is oriented vertically downward; and wherein said rear leg support assembly is constructed so that said rear leg and said gun butt support assembly can be rotated to place said gun butt support assembly vertically downward and said rear leg upright; and wherein said front leg support assembly includes a plate for supporting a hand gun butt.

6. The gun support according to claim 3 wherein said gun butt support assembly is attached to said second elongated member so that said gun butt support assembly is upright when said rear leg is oriented vertically downward; and wherein said rear leg support assembly is constructed so that said rear leg and said gun butt support assembly can be rotated to place said gun butt support assembly vertically downward and said rear leg upright; and wherein said front leg support assembly includes a plate for supporting a hand gun butt.

* * * * *